US006000404A

United States Patent [19]

Case et al.

[11] Patent Number: 6,000,404

[45] **Date of Patent: *Dec. 14, 1999**

[54] SMOKING ARTICLES

[75] Inventors: Paul David Case, Southampton; Alan George Stephenson, Ringwood, both of United Kingdom

[73] Assignee: British American Tobacco (Investments) Limited, London, United Kingdom

[ * ] Notice: This patent is subject to a terminal disclaimer.

[21] Appl. No.: 09/031,501

[22] Filed: Feb. 26, 1998

Related U.S. Application Data

[63] Continuation of application No. 07/814,779, Dec. 30, 1991, which is a continuation of application No. 07/541,861, Jun. 21, 1990, abandoned.

[51] Int. Cl.[6] ..... A24B 15/00; A24B 15/10; A24B 15/18; A24D 3/04; A24D 1/02

[52] U.S. Cl. ..... 131/331; 131/334; 131/342; 131/365

[58] Field of Search ..... 131/334, 342, 131/365, 331

[56] References Cited

U.S. PATENT DOCUMENTS

| | | |
|---|---|---|
| 3,744,496 | 7/1973 | McCarty et al. . |
| 4,108,151 | 8/1978 | Martin et al. . |
| 4,231,377 | 11/1980 | Cline et al. . |
| 4,420,002 | 12/1983 | Cline . |
| 4,461,311 | 7/1984 | Mathews et al. . |
| 4,624,268 | 11/1986 | Baker et al. . |
| 4,721,120 | 1/1988 | Greig et al. . |
| 4,915,118 | 4/1990 | Kaufman et al. . |
| 4,942,888 | 7/1990 | Montoya et al. . |
| 5,143,098 | 9/1992 | Rogers et al. . |

FOREIGN PATENT DOCUMENTS

| | | | |
|---|---|---|---|
| 2094130A | 4/1981 | United Kingdom | A24D 1/100 |
| 2139869 | 11/1984 | United Kingdom . | |
| 2191930 | 12/1987 | United Kingdom . | |
| 2209269 | 5/1989 | United Kingdom . | |

*Primary Examiner*—Stanley S. Silverman
*Assistant Examiner*—Kevin Cronin
*Attorney, Agent, or Firm*—Middleton & Reutlinger; John F. Salazar; Charles G. Lamb

[57] ABSTRACT

The invention relates to a cigarette paper having a low total filler content, 20% by weight of the paper or less, a proportion of the filler being a filler capable of effecting visible sidestream smoke reduction. The basis weight of tbh paper is about 30 g $m^{-2}$ or more.

Smoking articles made with such papers provide a synergistic sidestream smoke component reduction when compared with control cigarettes. Papers according to thee invention with the addition of various burn additives are also described.

2 Claims, No Drawings

SMOKING ARTICLES

This is a continuation application of application Ser. No. 07/814,779, filed Dec. 30, 1991, which is a continuation of Ser. No. 07/541,861 filed Jun. 21, 1990, now abandoned.

The invention the subject of the present application relates to paper wrappers for wrapping smoking materials of smoking material rods of smoking articles. Hereinafter such wrappers are referred to as cigarette papers.

It has previously been proposed to provide cigarette paper comprising magnesium oxide, the purpose of such paper being to effect, in comparison with a conventional cigarette paper, a reduction in visible sidestream smoke. This cigarette paper has, however, proved to be less than fully satisfactory. Thus, for example, cigarettes incorporating the prior proposed sidestream-smoke reducing paper were noticed by smokers to exhibit a mainstream smoke off-taste and poor ash formation.

It is an object of the subject invention to provide an improved sidestream-smoke reducing cigarette paper.

It is a further object of the subject invention to provide an improved low sidestream smoke cigarette or similar low sidestream smoke smoking article.

The subject invention provides cigarette paper comprising a total filler content of about twenty percent by weight, or less, a proportion at least of the filler being a filler capable of effecting visible sidestream reduction, the weight of the paper being about thirty grams per square meter or more.

The subject invention also provides a smoking article comprising a smoking material rod, which rod comprises smoking material and a paper wrapper circumscribing said smoking material, and said paper of said paper wrapper comprising a total filler content of about twenty percent by weight or less, a proportion at least of the filler being a filler capable of effecting a reduction in visible sidestream, the weight of said paper being about thirty grams per square meter or more.

Preferably, the filler which effects a reduction in visible sidestream is magnesium oxide and/or magnesium hydroxide or high surface area chalk or mixtures thereof. Magnesium oxide utilised for the purposes of the present invention is preferably a reactive grade of magnesium oxide.

In addition to the visible sidestream reducing filler, the filler may comprise conventional chalk. If conventional chalk is present, it is preferably present in a range of about twelve percent by weight of the paper to about three percent by weight of the paper, and more preferably does not consitute more than about ten percent by weight of the paper.

Suitably, the visible sidestream reducing filler content is, in a range of about four percent to about eighteen percent by weight, but is advantageously at or above about seven percent by weight.

The inherent permeability i.e. that due to viscous flow, of the paper is advantageously about ten Coresta units or less. The permeability is suitably about seven Coresta units or less and is more suitably about five Coresta units or less.

The air permeability of a paper expressed in Coresta Units is the amount of air in cubic centimeters, which passes through one square centimeter of the paper in one minute at a constant pressure difference of 1.0 kilopascal.

Inherently porous cigarette paper consists of an interlocking network of fibres, which fibres are usually substantially wholly or mainly cellulose fibres, interspersed with particles of a filler, calcium carbonate for example. Openings in the fibre/filler matrix are of the order of 1 um wide, which dimension is small compared with the thickness of the paper (usually 20 to 50 um) and the flow of air through such openings is governed by viscous forces. However, when paper is perforated after the paper making process, the perforations are relatively large, usually having width dimensions of the same order of magnitude as the paper thickness, and the flow of air through such perforations is governed by inertial forces.

It is thus to be observed that when the permeability of a perforated paper is determined in accordance with the Coresta permeability determination method, the permeability value obtained will comprise the sum of the permeability due to viscous flow through the openings inherent from the paper making process and the permeability due to inertial flow through the perforations. A paper will also exhibit the same two permeability components if, although not perforated, the paper comprises, in addition to the small, viscous flow holes, larger inertial flow holes, which latter holes may be referred to as pinholes. Paper of this last mentioned construction may result, for example, from a defective paper making technique.

The total air flow through a paper may be expressed as:

$$Q=ZAP+Z'A(P)^n$$

where

Q is the air flow ($cm^3$ $min^{-1}$

A is the area of paper ($cm^2$) exposed to the flowing air

P is the pressure difference across the paper (kilopascals)

Z is the permeability of the paper due to viscous flow through the openings inherent from the paper making process in Coresta Units (cm $min^{-1}$ $kilopascal^{-1}$ Z' is the permeability of the paper due to inertial flow through perforations and/or pinholes (cm $min^{-1}$ $kilopascal^{-1}$) and n is a constant for a given set of perforation holes or pinholes, where $0.5<n<1.0$, the exact value of n depending on the size of the perforations or pinholes.

The total permeability of a paper comprising perforations and/or pinholes is (Z+Z') and the relative values of Z and Z' for a given such paper can be obtained by measuring the flow of air through the paper at a series of pressure differences across the paper and numerically regressing the Q/P data in the above equation using a value of n in accordance with the mean size of the perforations/pinholes in the paper.

It is to be understood that the value of 10 Coresta units recited above in relation to the wrappers of smoking articles according to the subject invention refers to the permeability of the wrappers due to viscous flow. It will thus be appreciated that it is conceivable for a wrapper of a smoking article according to the subject invention to have a total permeability, i.e. the permeability determined using the Coresta permeability determination method, exceeding 10 Coresta units should the wrapper comprise perforations; and/or pinholes.

Conveniently, the maximum weight of total filler is about 8 grams per square meter.

The weight of paper is suitably about thirty five grams per square meter or more, and more suitably about forty grams per square meter or more.

By preference papers according to the subject invention comprise a burn additive in a range of about two to about ten percent by weight. Those skilled in cigarette paper technology will readily be able to identify burn additives. Additives found to be effective for the purpose of the subject invention include sodium acetate, tri-potassium citrate, potassium di-hydrogen orthophosphate and potassium tartrate. The salts of the burn additives may be alkaline or acidic in aqueous solution. The burn additives may be either burn rate promoters or burn rate retardants.

The smoking material of a smoking article in accordance with the subject invention may comprise a proportion of expanded tobacco. The expanded tobacco suitably has a bulk density in a range bf 100 mg $cm^{-3}$ to 175 mg $cm^{-3}$. The proportion of the smoking material accounted for by expanded tobacco may be at least about ten percent by weight and may suitably be at least about twenty percent by weight, more suitably at least about thirty percent by weight, and even more suitably at least about forty percent by weights The length of smoking material rods of smoking articles in accordance with the subject invention is preferably not less than 45 mm and is advantageously at least 55 mm. The smoking material rods are preferably of uniform cross-sectional shape and dimensions throughout the lengths thereof. If, as is commonly the case with cigarettes and like smoking articles, a smoking material rod of a smoking article in accordance with the subject invention is of a uniform circular cross-section, the circumference of the rod may be in a range of 10 mm to 30 mm. Whereas significant and commercially useful sidestream smoke reduction advantages are to be obtained from smoking articles in accordance with the present invention when the rod circumference is 25±5 mm, further advantage is to be had when the rod circumference is below the 25±5 mm range down to 10 mm. Preferably, the rod circumference of smoking articles according to the subject invention is not less than 12.5 mm.

When smoked under standard machine smoking conditions, smoking articles in accordance with the subject invention advantageously provide not less than five puffs and more preferably not less than six puffs.

Preferably, smoking articles in accordance with the subject invention comprise filter or mouthpiece means attached to the smoking material rod at one end thereof.

Smoking articles in accordance with the subject invention may incorporate ventilation means.

It is also to be understood that smoking articles according to the subject invention may be wrapped in a wrap which may comprise one or more overlying or underlying wrapper sheet materials.

EXAMPLE 1

First control cigarettes were produced consisting of 24.73 mm circumference, 64 mm long cigarette rods and 20 mm long cellulose acetate filters. The density of the cut tobacco filler of the cigarette rods was 256 mg $cm^{-3}$. The cigarette wrappers were of a conventional cigarette paper of 45 Coresta Units (C.U.) permeability and a basis weight of 37.0 g $m^{-2}$. The paper comprised 28.8% calcium carbonate filler. These cigarettes were designated Cigarettes 1.

Second control cigarettes, designated Cigarettes 2, were produced consisting of 24.82 mm circumferences 64 mm long cigarette rods and 20 mm long cellulose acetate filters. The density of the cut tobacco filler of the cigarette rods was 261 mg $cm^{-3}$. The cigarette wrappers were of a paper permeability of 61 C.U. and a basis weight of 34.8 g $m^2$. The paper comprised 15.4% calcium carbonate and 11.0% magnesium oxide.

Third control cigarettes 3 were produced consisting of 24.82 mm circumference, 64 mm long cigarette rods and 20 mm long cellulose acetate filters. The density of the cut tobacco filler was 252 mg $cm^{-3}$. The cigarette rod wrappers were of a paper permeability of 6.0 C.U. and a basis weight of 35.6 g $m^{-2}$. The paper comprised 22.4% calcium carbonate filler.

Cigarettes A were produced, which cigarettes were cigarettes according to the subject invention. The cigarettes consisted of 24.83 mm circumference, 64 mm long cigarette rods and 20 mm long cellulose acetate filters. The density of the cut tobacco filler was 248 mg $cm^{-3}$. The cigarette rod wrappers were of a paper permeability of 7.0 C.U. and a basis weight of 36.6 g $m^{-2}$. The paper comprised 4.9% calcium carbonate filler and 10.5% magnesium oxide. filler.

Cigarettes 1–3 and A were smoked under standard machine smoking conditions, i.e. a 35 $cm^3$ puff of 2 seconds duration every minute, to a cigarette tobacco rod butt 8 mm long, and measurements were made of the total sidestream yields per cigarette of particulate matter, on a water and nicotine free basis (PMWNF), total nicotine alkaloids (TNA), carbon monoxide (CO) and carbon dioxide ($CO_2$). The average measured values are given in Table 1.

The predicted values shown in Table 1 for Cigarettes A were calculated from the measured values for Cigarettes 1–3. In this instance the predicted values have been calculated based on the percentage reductions achieved for each control cigarette with respect to the sidestream smoke component yield of the first control cigarette. Thus, for example, the predicted value of PMWNF for Cigarettes A is calculated as 28.6 (1–0.12)(1–0.09)=22.9, 28.6 being the PMWNF value for the first control cigarettes, 0.12 being the value of. PMWNF for the first control cigarettes minus that for the second control cigarettes expressed as a fraction of that for the first control cigarettes, i.e. the PMWNF reduction. ratio, and 0.09 being the PMWNF reduction ratio for the third control cigarettes with respect to the first control cigarettes.

The measured value of PMWNF for Cigarettes A was 20.3. It is thus seen that cigarettes according to the subject invention exhibit a synergistic reduction in PMWNF. A synergistic reduction is also seen in TNA, CO and $CO_2$ yields.

TABLE 1

| CIGARETTES | PMWNF (mg/cig) | TNA (mg/cig) | CO (mg/cig) | $CO_2$ (mg/cig) | Puff Number |
|---|---|---|---|---|---|
| 1 | 28.6 | 5.5 | 60.6 | 424 | 9.4 |
| 2 | 25.1 | 4.7 | 65.3 | 465 | 10.0 |
| 3 | 26.0 | 5.3 | 51.4 | 390 | 9.8 |
| A Predicted | 22.9 | 4.5 | 55.6 | 425 | — |
| A Measured | 20.3 | 4.2 | 42.4 | 373 | 11.1 |

EXAMPLE 2

The first control cigarettes, Cigarettes 1, and the second control cigarettes, Cigarettes 2, were identical to those in Example 1.

Third control cigarettes, Cigarettes 4, were produced consisting of 24.77 mm circumference, 64 mm long cigarette rods and 20 mm long cellulose acetate filters. The density of the cut tobacco filler of the cigarette rods was 252 mg $cm^{-3}$. The cigarette rod wrappers were of a paper permeability of 6.0 C.U. and a basis weight of 36.7 g $m^{-2}$. The paper comprised 19.6% calcium carbonate filler.

Cigarettes A according to the invention and identical to those Cigarettes A of Example 1 were produced.

When these cigarettes, Cigarettes 11, 2, 4 and A were smoked under standard machine smoking conditions measurements were made of the total sidestream yields per cigarette of PMWNF, TNA, CO and CO. The average measured values are given in Table 2, along with the predicted values for each of these sidestream smoke components. It can be seen that cigarettes according to the subject invention exhibit a synergistic sidestream smoke component reduction in each of the measured components.

TABLE 2

| CIGARETTES | PMWNF (mg/cig) | TNA (mg/cig) | CO (mg/cig) | $CO_2$ (mg/cig) | Puff Number |
|---|---|---|---|---|---|
| 1 | 28.6 | 5.5 | 60.6 | 424 | 9.4 |
| 2 | 25.1 | 4.7 | 65.3 | 465 | 10.0 |
| 4 | 26.1 | 5.2 | 46.0 | 373 | 10.7 |
| A Predicted | 22.9 | 4.4 | 49.7 | 407 | — |
| A Measured | 20.3 | 4.2 | 42.4 | 373 | 11.1 |

The following examples illustrate the sidestream smoke component yields obtained from smoking articles wrapped in papers according to the present invention. In each case the physical characteristics of the paper wrappers have been varied to some extent.

EXAMPLE 3

A series of cigarettes was produced consisting of conventional circumference 59 mm long cigarette rods and 20 mm long cellulose acetate filters. The average density of the cut tobacco filler of the cigarette rods of each of the cigarettes was 205 mg $cm^{-3}$. Identical tobacco blends were used in each cigarette, the blend comprising about 40% DIET expanded tobacco lamina. Table 3 gives details of each of the papers for Cigarettes A to E. The papers were treated with increased loading levels of sodium acetate. The paper of Cigarette A is identical to that of Cigarette A in Examples 1 and 2.

TABLE 3

| PAPER OF CIGARETTE | A | B | C | D | E |
|---|---|---|---|---|---|
| Basis weight (gsm) | 36.6 | 37.9 | 37.8 | 37.4 | 37.0 |
| % $CaCO_3$ | 4.9 | 5.2 | 4.9 | 4.4 | 5.0 |
| % MgO | 10.5 | 11.5 | 11.8 | 10.3 | 10.3 |
| Permeability (C.U.) | 7.0 | 7.0 | 5.0 | 5.0 | 64* |
| % NaAc | 0 | 2.1 | 4.9 | 6.25 | 2.1 |

*Paper electrostatically perforated up to this total permeability.
NaAc = Sodium acetate.

Each of these cigarettes was smoked under standard machine smoking conditions and measurements were made of their sidestream smoke component yields as detailed in Table 4. The control cigarette, Cigarette 5, was of a comparable cigarette format and had a tobacco density of 246 mg $cm^{-3}$. The papers of Cigarette 5 have a permeability of 50 C.U. and a basis weight of 29 g $m^{-2}$. The papers comprised 21% chalk and 2% mixed sodium citrate and potassium citrate.

TABLE 4

| CIGARETTE | PMWNF (mg/cig) | TNA (mg/cig) | CO (mg/cig) | $CO_2$ (mg/cig) | Puff Number |
|---|---|---|---|---|---|
| 5 | 25.8 | 3.5 | 51 | 421 | 7.8 |
| A | 16.6 | 2.6 | 34 | 274 | 7.5 |
| | (36) | (26) | (33) | (40) | |
| B | 14.1 | 2.7 | 40 | 303 | 6.6 |
| | (45) | (23) | (22) | (28) | |

TABLE 4-continued

| CIGARETTE | PMWNF (mg/cig) | TNA (mg/cig) | CO (mg/cig) | $CO_2$ (mg/cig) | Puff Number |
|---|---|---|---|---|---|
| C | 10.7 | 2.1 | 36 | 295 | 7.4 |
| | (58) | (40) | (29) | (30) | |
| D | 10.3 | 2.0 | 33 | 305 | 6.3 |
| | (60) | (43) | (35) | (28) | |
| E | 14.7 | 2.7 | 35 | 302 | 7.8 |
| | (43) | (23) | (31) | (28) | |

Figures in brackets represent % reduction relative to the control.

EXAMPLE 4

A series of cigarettes F to H was produced in a format identical to those cigarettes of Example 3. The identical tobacco blend was used for the cigarettes of Examples 3 and 4, the blend comprising 40% DIET expanded tobacco lamina.

The paper of Cigarettes A was treated with loading levels of tri-potassium citrate of 3.3%, 5.2% and 10.1% respectively.

The control cigarette is the same as that of Example 3.

Table 5 details the measured sidestream smoke component yields obtained when the cigarettes were smoked under standard machine smoking conditions. For ease of reference and comparison, the sidestream yields of Cigarettes A and C are included in the Table.

TABLE 5

| CIGARETTE | PMWNF (mg/cig) | TNA (mg/cig) | CO (mg/cig) | $CO_2$ (mg/cig) | Puff Number |
|---|---|---|---|---|---|
| 5 | 25.8 | 3.5 | 51 | 421 | 7.8 |
| A | 16.6 | 2.6 | 34 | 274 | 7.5 |
| | (36) | (26) | (33) | (34) | |
| C | 10.7 | 2.1 | 36 | 295 | 7.4 |
| | (59) | (40) | (29) | (30) | |
| F | 13.3 | 2.5 | 37 | 291 | 6.0 |
| | (48) | (29) | (27) | (31) | |
| G | 11.7 | 2.6 | 37 | 291 | 5.2 |
| | (55) | (26) | (27) | (31) | |
| H | 11.1 | 2.3 | 37 | 288 | 5.3 |
| | (57) | (34) | (27) | (32) | |

Figures in brackets represent % reductions relative to the control.

In this series of cigarettes the blend used throughout was constant but with the citrate-treated paper series, Cigarettes F to H. the densities were reduced from the average of 205 mg $cm^{-3}$ for Cigarettes A and C to 188 mg $cm^{-3}$, 190 mg $cm^{-3}$ and 192 mg $cm^{-3}$ with a view to seeing whether these products could maintain adequate physical characteristics.

As can be seen from the results tri-potassium citrate at equal loading levels to sodium acetate loading levels produces an effect which is similar to that seen with sodium acetate. In the mainstream smoke (details of which are not given here) at equal levels of inclusion of tri-potassium citrate and sodium acetate there is a small but useful reduction in the CO/PMWNF ratios of citrate-treated papers relative to sodium acetate treated papers.

EXAMPLE 5

In this series of cigarettes, papers according to the invention were utilised which had lower basis weights. The paper characteristics of Cigarettes J to L are outlined in Table 6. The papers were treated with sodium acetate.

TABLE 6

| PAPER OF CIGARETTE | J | K | L |
|---|---|---|---|
| Basis Weight (gsm) | 30.0 | 31.4 | 31.4 |
| % $CaCO_3$ | 3.7 | 3.4 | 3.5 |
| % MgO | 13.7 | 13.3 | 14.0 |
| Permeability (C.U.) | 6 | 6 | 58* |
| % NaAc | 0.2 | 3.1 | 3.2 |

*paper elecrostatically perforated to this total permeability.

The cigarettes were of the same format as those of Examples 3 and 4 and incorporated the same tobacco blend with 40% DIET expanded tobacco lamina.

The cigarettes were smoked under standard machine smoking conditions and the sidestream smoke component yields were measured. Details of the obtained yields are outlined in Table 7.

TABLE 7

| CIGARETTE | PMWNF (mg/cig) | TNA (mg/cig) | CO (mg/cig) | $CO_2$ (mg/cig) | Puff Number |
|---|---|---|---|---|---|
| 5 | 25.8 | 3.5 | 51 | 421 | 7.8 |
| J | 14.2 | 2.5 | 26 | 271 | 7.8 |
| | (45) | (29) | (49) | (36) | |
| K | 11.4 | 2.3 | 31 | 302 | 7.1 |
| | (56) | (34) | (39) | (28) | |
| L | 11.9 | 2.5 | 32 | 316 | 7.6 |
| | (54) | (29) | (37) | (25) | |

Figures in brackets represent % reductions relative to the control.

Cigarettes J show the effect of reducing basis weight on sidestream smoke components. Cigarettes R and L illustrate the effect of sodium acetate on sidestream visibility as seen previously.

EXAMPLE 6

In contrast to Example 5, the following series of cigarettes was produced using paper of lower basis weight but with slightly higher paper permeability and slightly higher chalk loading levels. Details of the paper characteristics of Cigarettes M–R (there are no Cigarettes O) are given in Table 8.

TABLE 8

| PAPER | M | N | P | R |
|---|---|---|---|---|
| Basis weight (gsm) | 33.0 | 34.7 | 34.3 | 36.6 |
| % MgO | 9.6 | 8.9 | 8.8 | 9.8 |
| % $CaCO_3$ | 8.9 | 8.9 | 9.0 | 7.1 |
| Permeability (C.U.) | 11 | 9 | 58* | 8 |
| % NaAC | — | 3.1 | 3.1 | 4.7 |

*paper elecrostatically perforated to this total permeability.

Of these papers, only Cigarettes R were made. The tobacco blend was identical to that used in the previous examples. Further cigarettes Cigarettes S. were made, wherein papers of Cigarettes R were electrostatically perforated to a total permeability of 58 C.U.

For comparison purposes, Table 9 below lists the sidestream yields of Cigarettes R and S. and Cigarettes A and T. The papers of Cigarettes C were electrostatically perforated to a total permeability of 55 C.U. and used to produce Cigarettes T.

TABLE 9

| CIGARETTE | DENSITY (mg $cm^{-3}$) | PMWNF (mg/cig) | TNA (mg/cig) | CO (mg/cig) | $CO_2$ (mg/cig) | Puff Number |
|---|---|---|---|---|---|---|
| 5 | 246 | 25.8 | 3.5 | 51 | 421 | 7.8 |
| C | 183 | 10.4 | 2.0 | 30 | 261 | 6.0 |
| | | (60) | (43) | (41) | (38) | |
| T | 186 | 11.3 | 2.4 | 33 | 282 | 6.0 |
| | | (56) | (31) | (35) | (33) | |
| R | 183 | 13.6 | 2.3 | 33 | 274 | 6.1 |
| | | (47) | (34) | (35) | (35) | |
| S | 177 | 13.7 | 2.6 | 36 | 297 | 6.0 |
| | | (47) | (25) | (29) | (29) | |

Figures in brackets represent % reduction relative to control.

EXAMPLE 7

The following series of cigarettes was made utilising a high surface area chalk for Cigarettes U and W. Table 10 provides details of the paper characteristics of Cigarettes U to X.

Cigarettes U to X were smoked under standard machine smoking conditions and the sidestream smoke component yields were measured. Table 11 details the results.

TABLE 10

| PAPER OF CIGARETTE | U+ | V | W+ | X |
|---|---|---|---|---|
| Basis Weight (gsm) | 36.7 | 35.6 | 36.3 | 38.2 |
| % $CaCO_3$ | 16.2 | 9.9 | 10.6 | 8.0 |
| % MgO | — | 4.2 | 4.6 | 4.6 |
| Permeability (C.U.) | 4 | 5 | 6 | — |
| % NaAc | — | — | — | 4.3 |

+high surface area chalk.

When Cigarettes U and A are compared, it is apparent that substitution of high surf ace area chalk for MgO does not produce as good a result as MgO in terms of visible sidestream (PMWNF) reduction.

TABLE 11

| CIGARETTE | DENSITY (mg $cm^{-3}$) | PMWNF (mg/cig) | TNA (mg/cig) | CO (mg/cig) | $CO_2$ (mg/cig) | Puff Number |
|---|---|---|---|---|---|---|
| 5 | 246 | 25.8 | 3.5 | 51 | 421 | 7.8 |
| U+ | 205 | 17.4 | 2.8 | 32 | 266 | 7.5 |
| | | (33) | (20) | (37) | (37) | |
| V | 206 | 17.8 | 2.7 | 30 | 265 | 7.6 |
| | | (31) | (23) | (41) | (37) | |
| W+ | 209 | 17.5 | 2.9 | 35 | 286 | 7.5 |
| | | (32) | (17) | (31) | (32) | |
| X | 206 | 13.7 | 2.5 | 36 | 283 | 7.0 |
| | | (47) | (29) | (29) | (33) | |

Figures in brackets represent % reductions relative to the control.
+high surface area chalk.

EXAMPLE 8

A series of cigarettes was produced to illustrate the effects that papers according to the present invention have on sidestream smoke components when the papers are used as wrappers for tobacco rods of smoking articles.

The series of cigarettes comprised a number of control cigarettes, which control cigarettes included Cigarettes 1, 2, 3 and 4 mentioned earlier in this specification. Further control cigarettes, Cigarettes 6, 7, 8 and 9 were produced. The paper of Cigarettes 1 was treated with the burn additives sodium acetate, tri-potassium citrate, potassium dihydrogen orthophosphate and potassium tartrate as outlined in Table 12 below. The loading levels given are as a percentage by weight of the total basis weight of the treated papers.

TABLE 12

| PAPER OF CIGARETTE | ADDITIVE | LOADING LEVEL (% total basis weight of paper) |
|---|---|---|
| 6 | Sodium acetate | 7.2 |
| 7 | Tri-potassium citrate | 5.2 |
| 8 | Potassium dihydrogen orthophosphate | 5.9 |
| 9 | Potassium tartrate | 5.4 |

Cigarettes wrapped in papers according to the present invention were produced by treating the papers of Cigarettes A with the same burn additives as those of Cigarettes 6 to 9. The loading levels are given in Table 13 below. The loading levels are as a percentage by weight of the total basis weight of the treated papers. The cigarettes were denoted as Cigarettes AA to DD.

It will be seen that there is a reasonably good correlation between the loading levels of the control and inventive cigarettes.

TABLE 13

| PAPER OF CIGARETTE | ADDITIVE | LOADING LEVEL (% total basis weight of paper) |
|---|---|---|
| AA | Sodium acetate | 5.0 |
| BB | Tri-potassium citrate | 5.2 |
| CC | Potassium dihydrogen orthophosphate | 6.0 |
| DD | Potassium tartrate | 5.2 |

Table 14 below outlines the physical characteristics of these cigarettes. The smoking article format was that of substantially conventional circumference 64 mm long tobacco rods with 20 mm long cellulose acetate filters. The tobacco blend was the same as that used in Examples 1 and 2, i.e. 22% stem, 3% reconstituted tobacco sheet and 75% lamina tobacco of which 12% was DIET expanded lamina tobacco.

TABLE 14

| CIGARETTE | DENSITY ($mg/cm^3$) | PERMEABILITY (C.U.) | CIRCUMFERENCE (mm) |
|---|---|---|---|
| AA | 245 | 5.0 | 24.76 |
| 6 | 247 | 49 | 25.08 |
| BB | 247 | 7.0 | 24.74 |
| 7 | 247 | 55 | 24.81 |
| CC | 246 | 8.0 | 24.77 |
| 8 | 245 | 54 | 24.83 |
| DD | 252 | 6.0 | 24.75 |
| 9 | 243 | 54 | 24.91 |

The above cigarettes were smoked under standard machine smoking conditions and the sidestream smoke component yields were measured. Table 15 details the results obtained for the control cigarettes, Cigarettes 6 to 9.

TABLE 15

| CIGARETTE | PMWNF (mg/cig) | TNA (mg/cig) | CO (mg/cig) | $CO_2$ (mg/cig) | Puff Number |
|---|---|---|---|---|---|
| 6 | 22.5 | 4.8 | 64 | 459 | 6.9 |
| 7 | 23.3 | 5.1 | 68 | 488 | 6.5 |
| 8 | 25.1 | 4.6 | 52 | 407 | 8.7 |
| 9 | 25.7 | 5.2 | 57 | 421 | 6.8 |

Using the information from Table 15 and the information for the other control cigarettes, Cigarettes 1t 2 and 3, it is possible to work out the expected sidestream smoke component yields in the manner described in Example 1. However, in view of the fact that there are now three variables in the paper characteristics viz. the effect of magnesium oxide filler, the effect of reduced permeability and the effect of burn additive, the predicted value for PMWNF for Cigarettes AA is calculated as 28.6 (1−0.12) (1−0.09) (1−0.21)=18.1, 0.21 being the value of PMWNF for Cigarettes 1 minus that for Cigarettes 6 expressed as a fraction of that for Cigarettes 1.

The measured value of PMWNF for Cigarettes AA was 13.6. It is thus to be seen that cigarettes according to the subject invention exhibit a synergistic reduction in PMWNF.

Table 16 details the predicted and actual values for each of Cigarettes AA to DD. The control cigarette, Cigarette 3, is used in these calculations, as in Example 1.

Table 17 details the predicted and actual values for each of Cigarettes AA to DD when the control cigarette, Cigarette 4, is used in the calculation, as in Example 2.

TABLE 16

| CIGARETTE | PMWNF (mg/cig) | TNA (mg/cig) | CO (mg/cig) | $CO_2$ (mg/cig) | Puff Number |
|---|---|---|---|---|---|
| AA Predicted | 18.1 | 3.9 | 59 | 459 | |
| AA Actual | 13.6 | 3.6 | 44 | 375 | 9.2 |
| BB Predicted | 18.6 | 4.2 | 62 | 489 | |
| BB Actual | 17.4 | 4.4 | 56 | 419 | 8.0 |
| CC Predicted | 20.2 | 3.8 | 47 | 408 | |
| CC Actual | 15.2 | 3.6 | 55 | 395 | 10.7 |
| DD Predicted | 20.6 | 4.3 | 52 | 421 | |
| DD Actual | 15.5 | 4.3 | 44 | 363 | 8.3 |

TABLE 17

| CIGARETTE | PMWNF (mg/cig) | TNA (mg/cig) | CO (mg/cig) | $CO_2$ (mg/cig) | Puff Number |
|---|---|---|---|---|---|
| AA Predicted | 18.1 | 3.9 | 53 | 439 | |
| AA Actual | 13.6 | 3.6 | 44 | 375 | 9.2 |
| BB Predicted | 18.6 | 4.1 | 56 | 468 | |
| BB Actual | 17.4 | 4.4 | 56 | 419 | 8.0 |
| CC Predicted | 20.2 | 3.7 | 42 | 390 | |
| CC Actual | 15.2 | 3.6 | 55 | 395 | 10.7 |
| DD Predicted | 20.6 | 4.2 | 47 | 403 | |
| DD Actual | 15.5 | 4.3 | 44 | 363 | 8.3 |

The sidestream smoke component deliveries for all Examples were measured using the apparatus described in FIG. 2 of our co-pending U.K. application No. 8820498.7, to which the reader's attention is directed for reference thereto.

EXAMPLE 9

A paper was produced having a basis weight in the range of 45–50 g $m^{-2}$ and a permeability of about 5 C.U. The paper comprised between about 6% to about 8% magnesium oxide, and about 3% to about 5% calcium carbonate. The paper was designated Paper EE. This paper was treated to provide a loading level of 4.5% sodium acetate and designated Paper FF. Paper FF was electrostatically perforated to a total permeability of 65 C.U.

When all the papers with the above described specifications of the Examples were utilised in the manufacture of cigarettes, it was noted in the smoking of the cigarettes that ash formation was good, that there ways little or no off-taste in the mainstream smoke and that the papers were of good and uniform appearance.

All the cigarettes wrapped in the inventive papers were unventilated in the Examples.

We claim:

1. A cigarette paper comprising a total filler content of from 4% to 20% by weight of the paper, a proportion at least of the filler being a visible sidestream reducing filler selected from the group consisting of magnesium hydroxide or reactive grade magnesium oxide, the visible sidestream filler being present at from 4% to 14% by weight of the paper, the weight of the paper being at least 30 grams per square meter and the permeability of the paper being about 10 Coresta units or less.

2. A smoking article comprising a smoking material rod, which rod comprises a smoking material and a paper wrapper circumscribing said smoking material, said paper comprising a total filler of from 4 to 20% by weight of the paper, a proportion at least of said filler being a visible sidestream reducing filler selected from the group consisting of magnesium hydroxide or reactive grade magnesium oxide, the visible sidestream filler being present at from 4% to 14% by weight of the paper, the weight of the paper being at least about 30 grams per square meter and the paper permeability being about 10 Coresta units or less.

* * * * *